US009885220B2

(12) United States Patent
Nguyen et al.

(10) Patent No.: US 9,885,220 B2
(45) Date of Patent: Feb. 6, 2018

(54) HANGER RUNNING TOOL

(71) Applicant: Cameron International Corporation, Houston, TX (US)

(72) Inventors: Dennis P. Nguyen, Pearland, TX (US); Kristin Vorderkunz, Houston, TX (US)

(73) Assignee: Cameron International Corporation, Houston, TX (US)

( * ) Notice: Subject to any disclaimer, the term of this patent is extended or adjusted under 35 U.S.C. 154(b) by 285 days.

(21) Appl. No.: 14/449,971

(22) Filed: Aug. 1, 2014

(65) Prior Publication Data

US 2016/0032675 A1 Feb. 4, 2016

(51) Int. Cl.
*E21B 33/04* (2006.01)

(52) U.S. Cl.
CPC ..... *E21B 33/04* (2013.01)

(58) Field of Classification Search
CPC ..... E21B 33/043; E21B 33/04; E21B 43/10; E21B 23/02; E21B 33/03
See application file for complete search history.

(56) References Cited

U.S. PATENT DOCUMENTS 2,373,880 A * 4/1945 Driscoll ..... E21B 43/10 166/208
3,405,763 A * 10/1968 Pitts ..... E21B 33/043 166/208
3,421,580 A * 1/1969 Fowler ..... E21B 17/01 166/336
3,653,435 A * 4/1972 Reistle, III ..... E21B 43/14 166/313
3,913,670 A * 10/1975 Ahlstone ..... E21B 33/043 166/182
4,019,580 A * 4/1977 Garrett ..... E21B 33/043 166/120
4,067,388 A * 1/1978 Mouret ..... E21B 33/043 166/208
4,077,472 A * 3/1978 Gano ..... E21B 23/06 166/125
4,488,740 A * 12/1984 Baugh ..... E21B 33/043 285/106

(Continued)

OTHER PUBLICATIONS

PCT International Search Report & Written Opinion; Application No. PCT/US2015/040190; dated Mar. 14, 2016; 12 pages.

*Primary Examiner* — Kipp C Wallace
(74) *Attorney, Agent, or Firm* — Fletcher Yoder, P.C.

(57) ABSTRACT

A hanger running tool includes a radially outer surface having at least one recess extending circumferentially about at least a portion of a periphery of the hanger running tool. The hanger running tool also includes at least one alignment element disposed within the at least one recess. The at least one alignment element protrudes radially outward from the radially outer surface and is configured to contact a radially inner surface of a wellhead as the hanger running tool moves within the wellhead. In some embodiments, the hanger running tool includes a plurality of recesses each extending circumferentially about a respective portion of the periphery of the hanger running tool, and the recesses of the plurality of recesses are circumferentially separated from one another to enable fluid to flow through at least one axial flow slot of the hanger running tool.

17 Claims, 5 Drawing Sheets

(56) References Cited

U.S. PATENT DOCUMENTS

| | | | | |
|---|---|---|---|---|
| 4,807,705 | A * | 2/1989 | Henderson | E21B 33/043 166/208 |
| 4,903,776 | A * | 2/1990 | Nobileau | E21B 33/043 166/182 |
| 5,002,131 | A * | 3/1991 | Cromar | E21B 33/04 166/208 |
| 5,038,860 | A * | 8/1991 | Baugh | E21B 43/10 166/208 |
| 5,653,289 | A * | 8/1997 | Hosie | E21B 33/038 166/141 |
| 5,701,959 | A * | 12/1997 | Hushbeck | E21B 33/1293 166/118 |
| 8,887,818 | B1 * | 11/2014 | Carr | E21B 33/1204 166/118 |
| 2009/0107685 | A1 * | 4/2009 | Cain | E21B 33/03 166/379 |
| 2010/0126776 | A1 | 5/2010 | Trevino et al. | |
| 2010/0206588 | A1 * | 8/2010 | Nguyen | E21B 33/043 166/387 |
| 2011/0247799 | A1 * | 10/2011 | June | E21B 23/00 166/212 |
| 2011/0253389 | A1 | 10/2011 | Nguyen | |
| 2011/0278021 | A1 * | 11/2011 | Travis | E21B 33/047 166/386 |
| 2012/0024540 | A1 * | 2/2012 | Harsono | E21B 33/04 166/382 |
| 2012/0024542 | A1 | 2/2012 | Keat et al. | |
| 2012/0305269 | A1 * | 12/2012 | Bories | E21B 33/0415 166/382 |
| 2015/0285018 | A1 * | 10/2015 | Thornburrow | E21B 33/04 166/382 |

* cited by examiner

HANGER RUNNING TOOL

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Natural resources, such as oil and gas, are used as fuel to power vehicles, heat homes, and generate electricity, in addition to a myriad of other uses. Once a desired resource is discovered below the surface of the earth, drilling and production systems are often employed to access and extract the resource. These systems may be located onshore or offshore depending on the location of a desired resource. Further, such systems generally include a wellhead assembly through which the resource is extracted. These wellhead assemblies may include a wide variety of components and/or conduits, such as various casings, hangers, valves, fluid conduits, and the like, that control drilling and/or extraction operations. In some drilling and production systems, hangers, such as a casing hanger, may be used to suspend strings (e.g., piping) within the well to facilitate extraction of the resource. Such hangers may be disposed within and supported by a housing (e.g., a spool or a bowl) of the wellhead.

In some cases, a tool is utilized to facilitate running (e.g., lowering) the hanger into the wellhead. However, typical tools for running the hanger into the wellhead may not maintain alignment of the hanger with a bore of the wellhead during the running operation, and thus, the hanger may be installed within the wellhead in a tilted orientation (e.g., non-parallel to an axial axis of the bore). Such misalignment of the hanger may impede subsequent placement of a sealing assembly to seal an annular space between the hanger and the wellhead and/or may interfere with running other tools and strings through the wellhead. Additionally, typical tools for running the hanger may move circumferentially within the wellhead and may have hard radially outer surfaces that contact various surfaces within the wellhead (e.g., a radially inner surface of the housing) as the hanger is lowered to its landed position, which may wear the various surfaces of the wellhead.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Certain exemplary embodiments of the present disclosure include a hanger running tool for running (e.g., lowering) a hanger into a wellhead of a mineral extraction system. In particular, the disclosed embodiments include a hanger running tool having an alignment element (e.g., an alignment ring or alignment feature) extending circumferentially about at least a portion of a periphery of the hanger running tool. The alignment element protrudes from a radially outer surface of the hanger running tool, thereby reducing an annular space between the hanger running tool and an inner radially surface (e.g., bore) of the wellhead. Thus, the alignment element reduces radial movement of the hanger running tool within the wellhead, thereby facilitating alignment of the hanger running tool and associated hanger with an axial axis of the wellhead. In turn, proper alignment of the hanger facilitates subsequent installation of sealing assemblies and/or strings. Additionally, the alignment element may be formed from any suitable relatively soft material, such as any of a variety of polymers elastomers, and/or fabrics. The alignment element is configured to contact the inner radially surface of the wellhead as the hanger running tool is lowered into wellhead, and is also configured to block contact between the generally harder (e.g., metal) radially outer surface of the hanger running tool and the radially inner surface of the wellhead in a region proximate to the alignment element. Thus, the alignment element may act as a bumper, thereby reducing wear on the radially inner surface of the wellhead during hanger running operations.

Figure 1:
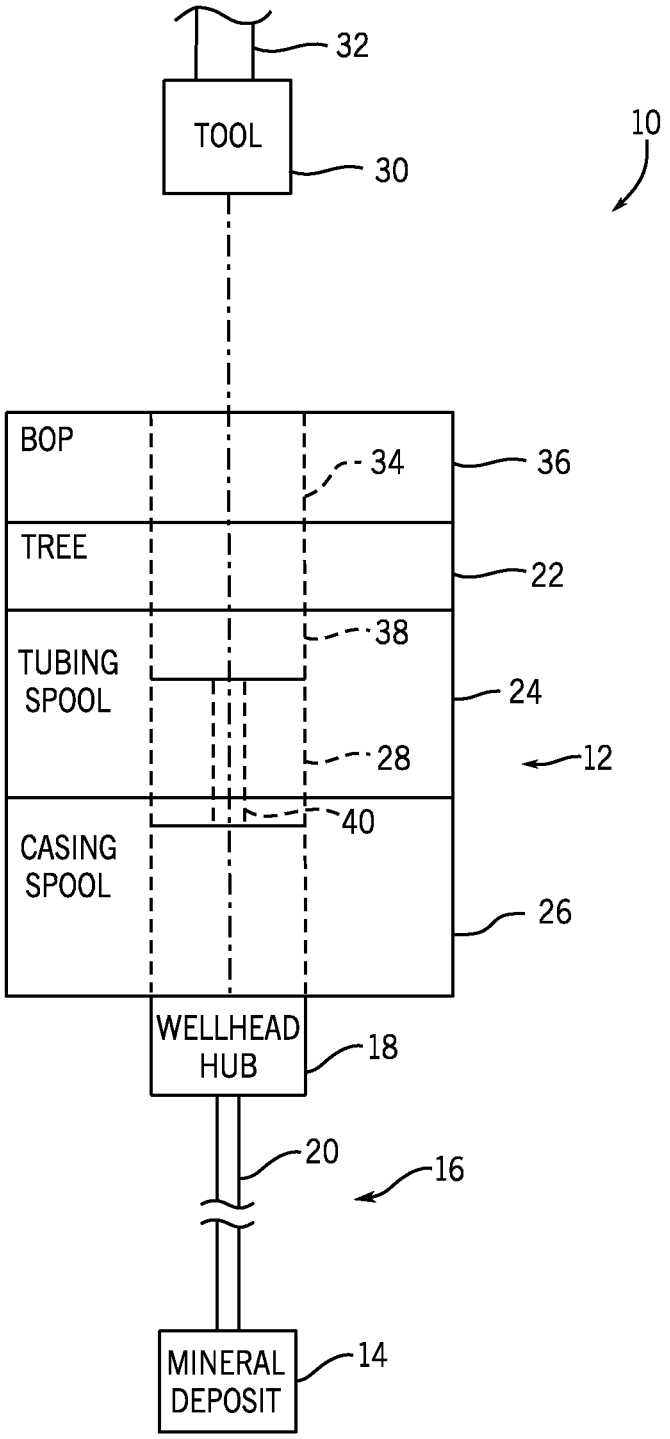
FIG. 1 is a block diagram of a mineral extraction system in accordance with an embodiment of the present disclosure.

FIG. 1 is a block diagram of an embodiment of a mineral extraction system 10. The illustrated mineral extraction system 10 may be configured to extract various minerals and natural resources, including hydrocarbons (e.g., oil and/or natural gas), from the earth, or to inject substances into the earth. In some embodiments, the mineral extraction system 10 is land-based (e.g., a surface system) or sub-sea (e.g., a sub-sea system). As illustrated, the system 10 includes a wellhead 12 coupled to a mineral deposit 14 via a well 16. The well 16 may include a wellhead hub 18 and a well bore 20. The wellhead hub 18 generally includes a large diameter hub disposed at the termination of the well bore 20 and is configured to connect the wellhead 12 to the well 16.

The wellhead 12 may include multiple components that control and regulate activities and conditions associated with the well 16. For example, the wellhead 12 generally includes bodies, valves, and seals that route produced minerals from the mineral deposit 14, regulate pressure in the well 16, and inject chemicals down-hole into the well bore 20. In the illustrated embodiment, the wellhead 12 includes a tree 22, a tubing spool 24, a casing spool 26, and a hanger 28 (e.g., a casing hanger). The system 10 may include other devices that are coupled to the wellhead 12, and devices that are used to assemble and control various components of the wellhead 12. For example, in the illustrated embodiment, the system 10 includes a tool 30 suspended from a drill string 32. As discussed in more detail below, in certain embodiments, the tool 30 may be a hanger running tool that is configured to be lowered from an offshore vessel into the wellhead 12. In other embodiments, such as surface systems, the tool 30 may be a hanger running tool that is configured to be lowered into the wellhead 12 via a crane or other supporting device.

The tree 22 generally includes a variety of flow paths (e.g., bores), valves, fittings, and controls for operating the well 16. For instance, the tree 22 may include a frame that is disposed about a tree body, a flow-loop, actuators, and valves. Further, the tree 22 may provide fluid communication with the well 16. For example, the tree 22 includes a tree bore 34. The tree bore 34 provides for completion and workover procedures, such as the insertion of tools into the well 16, the injection of various chemicals into the well 16, and so forth. Further, minerals extracted from the well 16 (e.g., oil and natural gas) may be regulated and routed via the tree 22. For instance, the tree 22 may be coupled to a jumper or a flowline that is tied back to other components, such as a manifold. Accordingly, produced minerals flow from the well 16 to the manifold via the wellhead 12 and/or the tree 22 before being routed to shipping or storage facilities. A blowout preventer (BOP) 36 may also be included, either as a part of the tree 22 or as a separate device. The BOP 36 may consist of a variety of valves, fittings, and controls to prevent oil, gas, or other fluid from exiting the well in the event of an unintentional release of pressure or an overpressure condition.

The tubing spool 24 provides a base for the tree 22. Typically, the tubing spool 24 is one of many components in a modular sub-sea or surface mineral extraction system 10 that is run from an offshore vessel or surface system. The tubing spool 24 includes a tubing spool bore 38. The tubing spool bore 38 connects (e.g., enables fluid communication between) the tree bore 34 and the well 16. Thus, the tubing spool bore 38 may provide access to the well bore 20 for various completion and workover procedures. For example, components can be run down to the wellhead 12 and disposed in the tubing spool bore 38 to seal off the well bore 20, to inject chemicals down-hole, to suspend tools down-hole, to retrieve tools down-hole, and so forth.

As will be appreciated, the well bore 20 may contain elevated pressures. For example, the well bore 20 may include pressures that exceed 10,000, 15,000, or even more pounds per square inch (psi). Accordingly, the mineral extraction system 10 may employ various mechanisms, such as seals, plugs, and valves, to control and regulate the well 16. For example, plugs and valves are employed to regulate the flow and pressures of fluids in various bores and channels throughout the mineral extraction system 10. For instance, the illustrated hanger 28 is typically disposed within the wellhead 12 to secure tubing and casing suspended in the well bore 20, and to provide a path for hydraulic control fluid, chemical injections, and so forth. The hanger 28 includes a hanger bore 40 that extends through the center of the hanger 28, and that is in fluid communication with the tubing spool bore 38 and the well bore 20.

Figure 2:
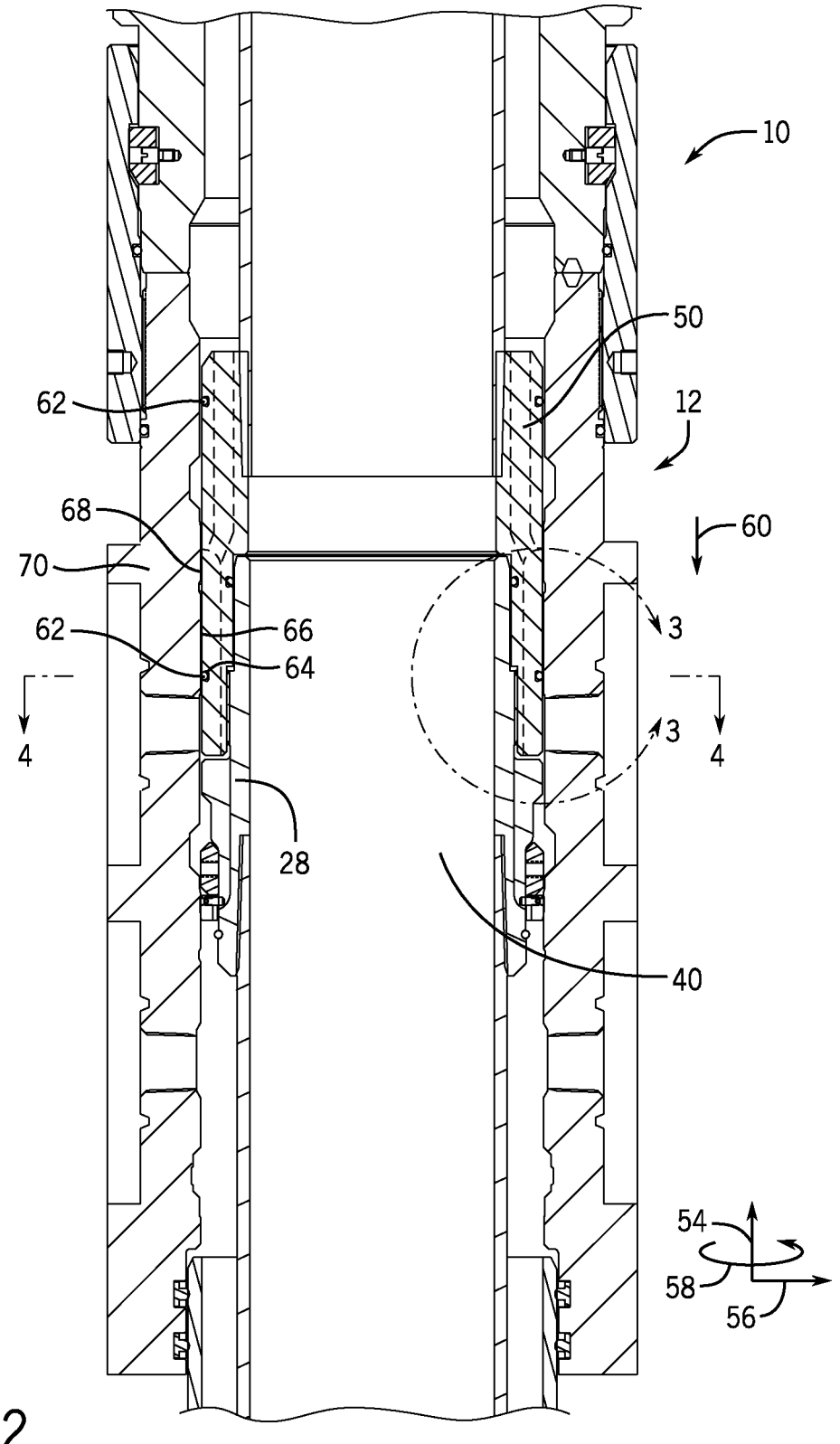
FIG. 2 is a partial cross-section of an embodiment of a hanger running tool disposed within a wellhead of the mineral extraction system of FIG. 1, FIG. 3. is a partial cross-section of an embodiment of an alignment element of the hanger running tool of FIG. 2, taken within line 3-3.

FIG. 2 is a partial cross-section of a hanger running tool 50 disposed within the wellhead 12 of the mineral extraction system 10. The mineral extraction system 10, and the components therein, may be described with reference to an axial axis or direction 54, a radial axis or direction 56, and a circumferential axis or direction 58. As illustrated, the hanger running tool 50 and the hanger 28 are coupled to one another and may be lowered together into the wellhead 12, as shown by arrow 60, to facilitate installation of the hanger 28 within the wellhead 12.

As shown, an alignment element 62 is disposed circumferentially about a portion of a periphery of the hanger running tool 50. The alignment element 62 is positioned within a cavity 64 formed in a radially outer surface 66 of the hanger running tool 50. As discussed in more detail below, the alignment element 62 protrudes radially outward from the radially outer surface 66 of the hanger running tool 50 to maintain axial alignment of the hanger running tool 50, and thus the hanger 28, during running and setting operations. Furthermore, the alignment element 62 may be formed from a relatively soft material, such as any suitable polymer, elastomer, and/or fabric. As the hanger running tool 50 moves within the wellhead 12, the alignment element 62 may contact various surfaces within the wellhead 12, such as a radially inner surface 68 of a housing 70 of the wellhead 12. Accordingly, the alignment element 62 may block contact between the relatively hard, metal radially outer surface 66 of the hanger running tool 50 and the surfaces of the wellhead 12, thereby reducing wear on the surfaces of the wellhead 12.

Any suitable number (e.g., 1, 2, 3, 4, 5, 6, 7, 8, 9, 10, or more) of alignment elements 62 may be provided about the periphery of the hanger running tool 50. For example, as shown in FIG. 2, multiple alignment elements 62 are positioned at different positions along the axial axis 54 of the hanger running tool 50. In embodiments having multiple alignment elements 62, each of the multiple alignment elements 62 may have any of the various features disclosed herein.

During extraction operations, the hanger 28 is used to suspend a string of tubing (e.g., piping) in the hanger bore 40, enabling various flows into and out of the well. Once the hanger 28 is lowered into a landing position within the wellhead 12, the hanger 28 may be mechanically locked into position. The hanger running tool 50 may then be uncoupled from the hanger 28 and extracted from the wellhead 12.

Figure 3:
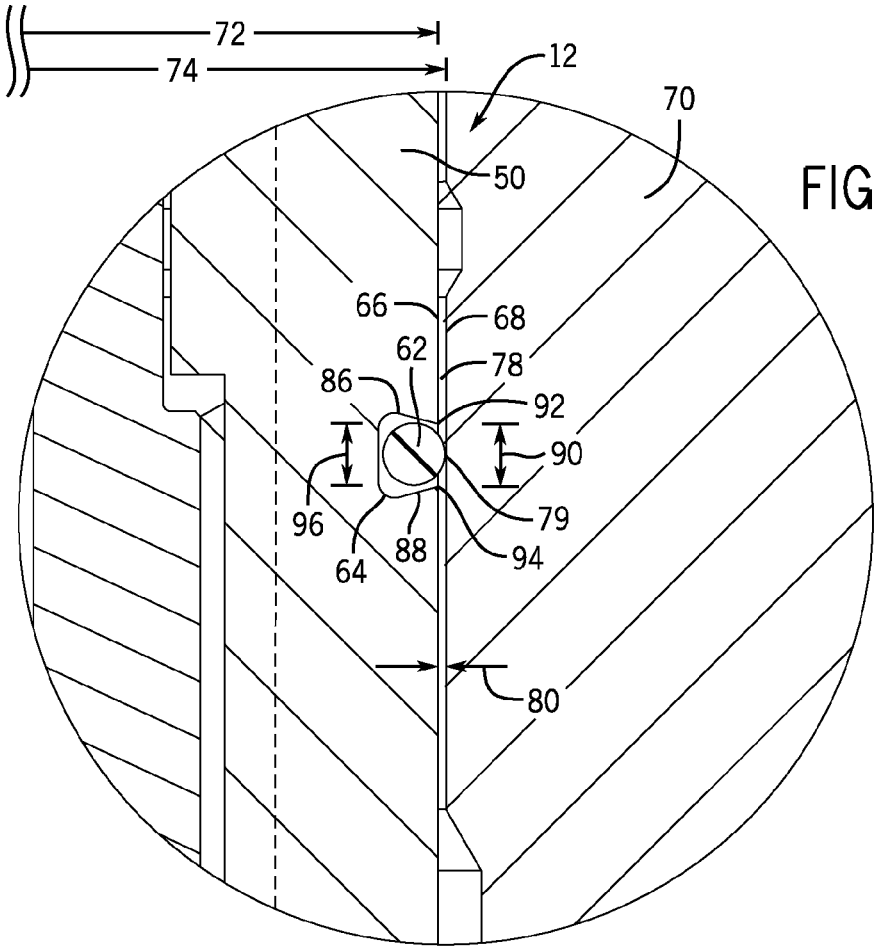

FIG. 3 is a partial cross-section of an embodiment of the alignment element 62 of the hanger running tool 50 of FIG. 2, taken within line 3-3. As shown in FIG. 3, a hanger running tool diameter 72 may be less than a wellhead diameter 74. Thus, the radially outer surface 66 of the hanger running tool 50 may be separated from the radially inner surface 68 of the housing 70 of the wellhead 12 by a radial clearance 80 defining an annular space 78 (e.g., gap).

In the illustrated embodiment, the alignment element 62 is disposed within the cavity 64 formed in the radially outer surface 66 of the hanger running tool 50. The alignment element 62 protrudes radially outward from the cavity 64 and from the radially outer surface 66 of the hanger running tool 50. Thus, the alignment element 62 extends into the annular space 78 and may contact the radial inner surface 68 of the housing 70 as the hanger running tool 50 moves through the wellhead 12.

In the illustrated embodiment, the alignment element 62 has a generally round cross-sectional shape and a curved radially outward surface 79, although the alignment element 62 may have any suitable shape in alternative embodiments. Further, as shown, the cavity 64 has a tapered configuration, which may secure the alignment element 62 within the cavity 64. For example, the cavity 64 includes a top axial surface 86 and a bottom axial surface 88 that are tapered (e.g., converge) toward one another along a radially outward direction from an interior portion of the hanger running tool 50 to the radially outer surface 66. In some embodiments, a first axial distance 90 between a radially outward top end 92 of the top axial surface 86 and a radially outward bottom end 94 of the bottom axial surface 88 is less than a second axial distance 96 (e.g., diameter) of the alignment element 62. Thus, the alignment element 62 may protrude from the cavity 64, while also being retained within by the cavity 64.

The cavity 64 illustrated in FIG. 3 is merely intended to be exemplary, and the cavity 64 may have any suitable cross-sectional shape or configuration for supporting the alignment element 62. Additionally, in some embodiments, the alignment element 62 may be coupled directly to the radially outer surface 66 of the hanger running tool 50 (e.g., via an adhesive). As noted above, any suitable number (e.g., 1, 2, 3, 4, 5, 6, 7, 8, 9, 10, or more) of alignment elements 62 may be provided about the periphery of the hanger running tool 50. In some embodiments, multiple alignment elements 62 may be disposed at various axial and/or circumferential locations about the hanger running tool 50.

The alignment element 62 may facilitate alignment of the hanger running tool 50, and thus the hanger 28, during running, cementing, and locking operations. For example, the alignment element 62 blocks movement of the hanger running tool 50 in the radial direction 56 and blocks tilting of the hanger running tool 50 relative to the axial axis 54. Thus, the alignment element 62 facilitates installation of the hanger 28 in an orientation aligned with (e.g., parallel to) the axial axis 54 of the wellhead bore, which may facilitate subsequent setting of a seal assembly and/or subsequent extraction operations, for example.

Additionally, the alignment element 62 may act as a bumper to block contact between the hanger running tool 12 and the radially inner surface 68 of the housing 70 and/or other surfaces within the wellhead 12. As the hanger running tool 50 is lowered into the wellhead 12, the relatively soft alignment element 62 may contact the radially inner surface 68 of the housing 70 and may block contact between the radially outer surface 66 of the hanger running tool 50 and the radially inner surface 68 of the housing 70. Thus, the alignment element 62 may reduce wear on the radially inner surface 68 of the housing 70, as well as other surfaces of the wellhead 12. The alignment element 62 disclosed herein is not configured to seal the annular space 78 and may enable air and/or other fluids to flow about the alignment element 62. Thus, the alignment element 62 is not configured to affect the flow and pressures of fluids within the wellhead 12.

Figure 4:
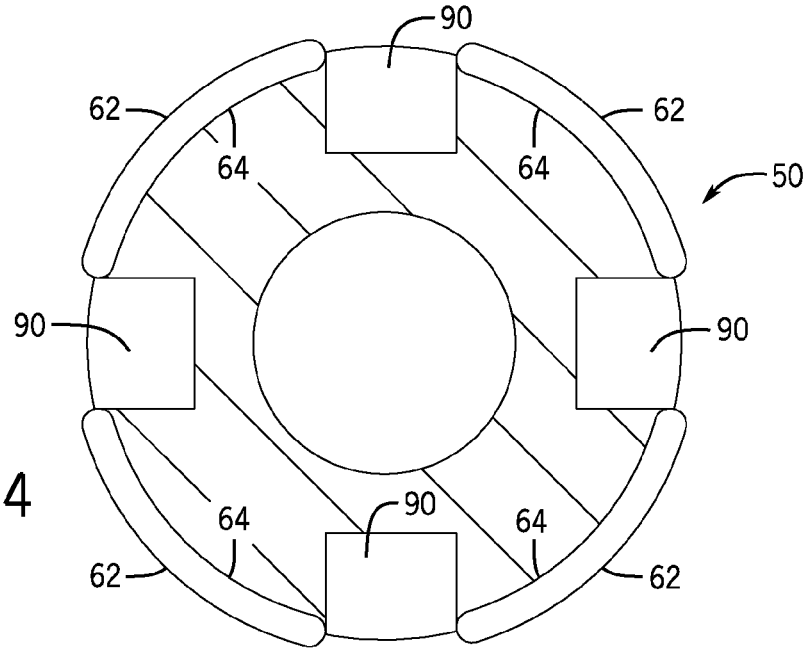
FIG. 4 is a top view of an embodiment of an alignment element of the hanger running tool of FIG. 2, taken along line 4-4.

FIG. 4 is a top view of an embodiment of the alignment element 62 of the hanger running tool 50 of FIG. 2, taken along line 4-4. As shown, multiple alignment elements 62 are disposed circumferentially about the periphery of the hanger running tool 50. Each alignment element 62 of the multiple alignment elements 62 extends between adjacent axial flow slots 90 of the hanger running tool 50. In such a configuration, the alignment elements 62 do not block a flow of fluid, such as cement, through the axial flow slots 90. Thus, the alignment elements 62 enable cementing operations for cementing casing or strings suspended from the hanger 28 through the wellbore 20. Although four alignment elements 62 and four axial flow slots 90 are shown, the hanger running tool 50 may include any suitable number (e.g., 1, 2, 3, 4, 5, 6, 7, 8, 9, 10, or more) of alignment elements 62 and/or axial flow slots 90. Additionally, the multiple alignment elements 62 and the axial flow slots 90 may be distributed axially and/or circumferentially about the periphery of hanger running tool 50 in any suitable arrangement.

In some embodiments, each of the multiple alignment elements 62 may be individually molded and/or cut to a suitable size or shape, and may subsequently be individually attached to the hanger running tool 50 in corresponding cavities 64 formed between the axial flow slots 90 via any suitable technique (e.g., adhesive, interference fit, or the like). In alternative embodiments, the alignment element 62 may be a continuous ring having holes cut at locations corresponding to the axial flow slots 90 to enable cement flow.

Figure 5:
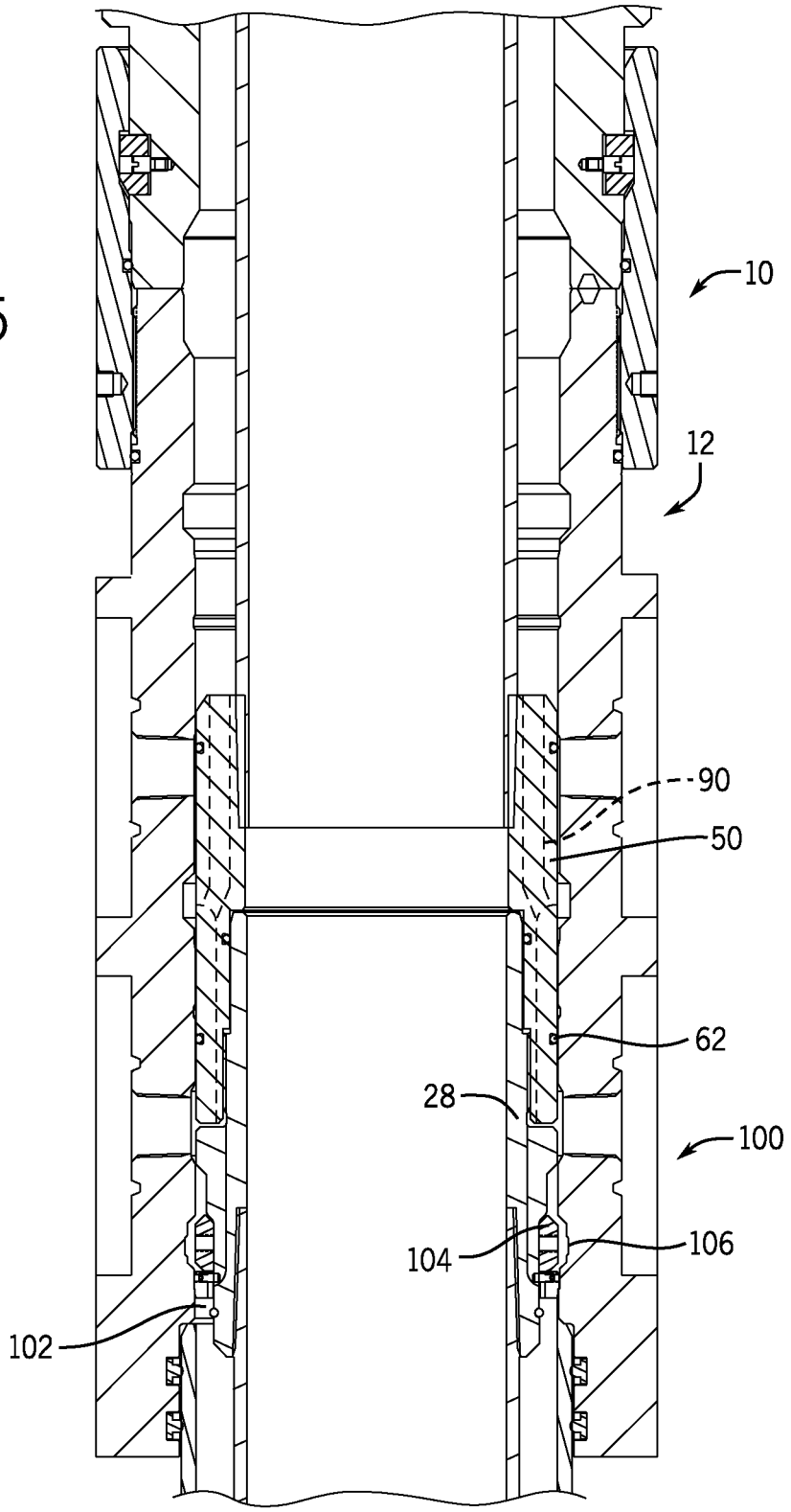
FIG. 5 is a partial cross-section of the hanger running tool of FIG. 2, with a hanger in a landing position within the wellhead.

FIG. 5 is a partial cross-section of the hanger running tool 50, with the hanger 28 in a landed position 100 within the wellhead 12. In the landed position 100, the hanger 28 is supported by a shoulder 102 within the wellhead 12. The shoulder 102 facilitates setting the hanger 28 in place. As discussed above, the alignment element 62 facilitates proper alignment of the hanger 28 within the wellhead bore, and thus, the hanger 28 is parallel to the axial axis 54 (e.g., is not substantially tilted relative to the wellhead bore) when the hanger 28 reaches the landed position 100. Once the hanger 28 reaches the landed position 100, the hanger 28 may be mechanically locked (e.g., secured) into placed within the wellhead 12. In the illustrated embodiment, the hanger 28 may be locked within the wellhead 12 (e.g., axially movement of the hanger 28 relative to the wellhead 12 is blocked) when a locking ring 104 engages a corresponding locking recess 106 within the wellhead 12. The locking ring 104 may be driven radially outwardly into the corresponding locking recess 106 via any suitable technique.

As noted above, the alignment element 62 may be positioned circumferentially about the hanger running tool 50 in a location that does not block the flow of cement through the axial flow slots 90. Thus, the alignment element 62 may also enable the hanger running tool 50 to maintain alignment of the hanger 28 during cementing operations, thereby facilitating proper alignment of the hanger 28 and/or the strings suspended from the hanger 28 as the strings are cemented in place within the wellhead 12.

Figure 6:
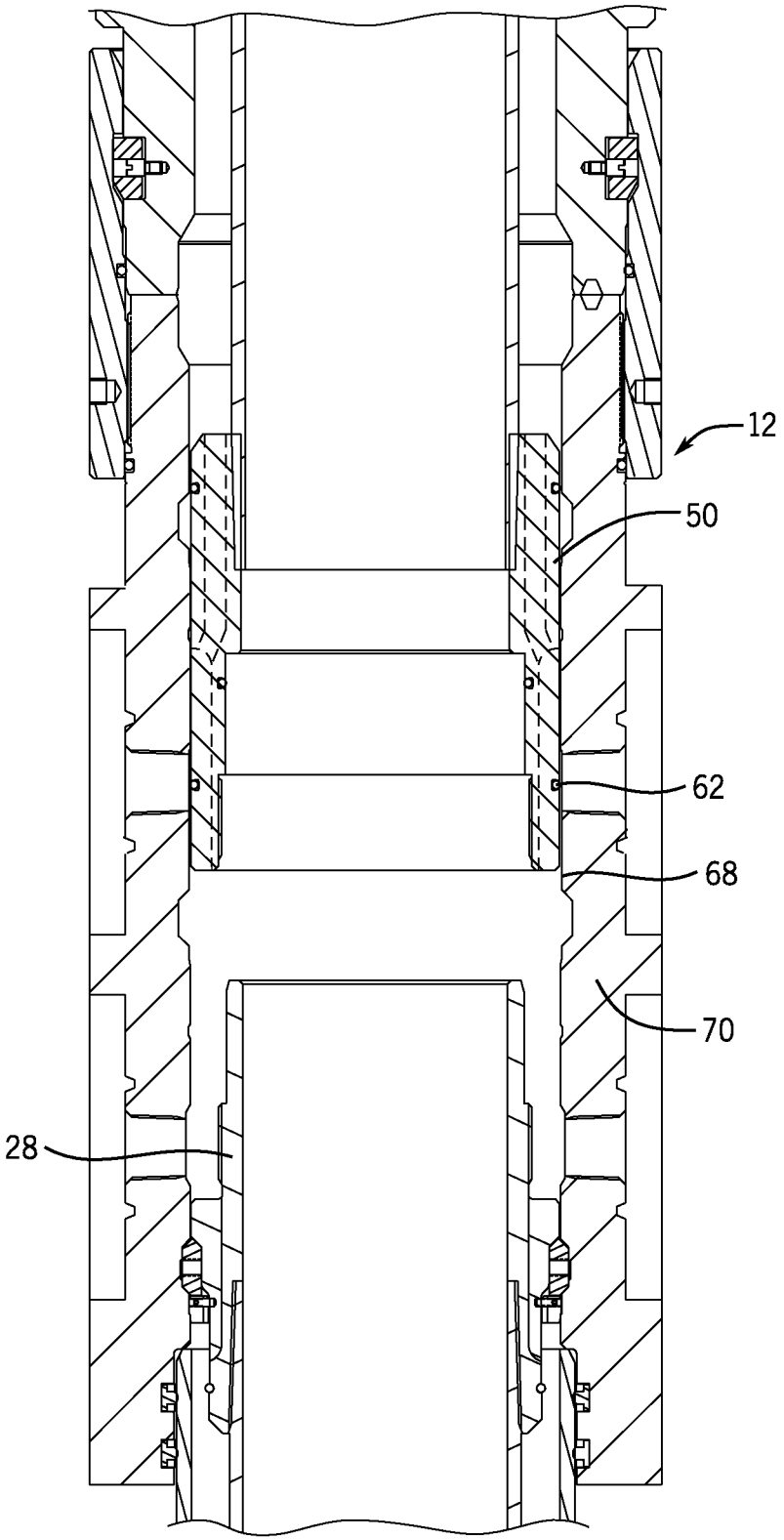
FIG. 6 is a partial cross-section of the hanger running tool of FIG. 2 separated from the hanger.

FIG. 6 is a partial cross-section of the hanger running tool 50 separated from the hanger 28. Once the hanger 28 is locked into place within the wellhead 12, the hanger running tool 50 may be unthreaded or uncoupled from the hanger 28 and extracted from the wellhead 12. The alignment element 62 may contact the radially inner surface 68 of the housing 70 as the hanger running tool 50 turns or moves axially upward within the wellhead 12. The alignment element 62 may block contact between the radially outer surface 66 of the hanger running tool 50 and the radially inner surface 68 of the housing 70 while the hanger running tool 50 is unthreaded and pulled out of the wellhead 12, thus reducing wear on the radially inner surface 68.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A hanger running tool system, comprising:

a hanger running tool configured to couple to a hanger and to facilitate setting the hanger within a wellhead of a mineral extraction system, the hanger running tool comprising:

a radially outer surface having at least one recess extending circumferentially about at least a portion of a periphery of the hanger running tool;

a plurality of axial flow slots formed in the radially outer surface of the hanger running tool: and a plurality of alignment elements disposed between axial flow slots and within the at least one recess, wherein the alignment elements protrude radially outward from the radially outer surface, are configured to contact a radially inner surface of the wellhead as the hanger running tool moves within the wellhead, have a longitudinal axis extending around a circumference of the hanger running tool, and are a non-annular structures thereby facilitating fluid flow from a first location on one side of the alignment elements along an axial axis of the hanger running tool to a second location on another side of the alignment elements along the axial axis of the hanger running tool when the hanger running tool is positioned within the wellhead.

2. The hanger running tool system of claim 1, wherein the at least one recess comprises a plurality of recesses each extending circumferentially about a respective portion of the periphery of the hanger running tool, and the recesses of the plurality of recesses are separated from one another along a circumference of the hanger running tool to enable fluid to flow through the at least one axial flow slot of the hanger running tool.

3. The hanger running tool system of claim 1, wherein the at least one recess comprises a plurality of recesses each extending circumferentially about a respective portion of the periphery of the hanger running tool, and the recesses of the plurality of recesses are separated from one another along an axial axis of the hanger running tool.

4. The hanger running tool system of claim 1, wherein the at least one recess comprises an upper axial surface and a lower axial surface that converge toward one another along a direction extending from an interior portion of the hanger running tool to the radially outer surface.

5. The hanger running tool system of claim 1, wherein the at least one alignment element comprises a curved radially outer wall.

6. The hanger running tool system of claim 1, wherein the alignment elements are formed from a polymer material, an elastomer material, a fabric material, or any combination thereof.

7. The hanger running tool system of claim 1, wherein the alignment elements are coupled to the at least one recess via an adhesive.

8. The hanger running tool system of claim 1, comprising the hanger and a locking ring, wherein the hanger running tool is coupled to the hanger and the locking ring is configured to mechanically lock the hanger within the wellhead.

9. A hanger running tool, comprising: a radially outer surface;

a plurality of axial flow slots formed in the radially outer surface to facilitate flow of fluid along the hanger running tool;

a plurality of alignment elements disposed circumferentially about a portion of a periphery of the hanger running tool and between adjacent axial flow slots of the plurality of axial flow slots, wherein the plurality of alignment elements have a longitudinal axis extending along a circumference of the hanger running tool; and at least one recess extending circumferentially about the periphery of the hanger running tool between the adjacent axial flow slots of the plurality of axial flow slots, wherein the alignment elements are disposed within the at least one recess, wherein the alignment elements protrude radially outward from the radially outer surface to facilitate alignment of the hanger running tool within a bore of a wellhead, and the hanger running tool is configured to couple to a hanger and to facilitate setting the hanger within the wellhead.

10. The hanger running tool of claim 9, wherein the at least one recess comprises an upper axial surface and a lower axial surface that converge toward one another along a direction extending from an interior portion of the hanger running tool to the radially outer surface.

11. The hanger running tool of claim 9, wherein the alignment elements are formed from a polymer material, an elastomer material, a fabric material, or any combination thereof.

12. The hanger running tool of claim 9, wherein the alignment elements are non-annular.

13. The hanger running tool of claim 9, wherein each of the plurality of axial flow slots extends from a first end located at a first axially-facing surface of the hanger running tool to a second end located at a second axially-facing surface of the hanger running tool.

14. A hanger running tool, comprising:

a plurality of alignment elements each protruding from a radially outer surface of the hanger running tool, wherein each of the plurality of alignment elements is non-annular, has a longitudinal axis which extends circumferentially about at least a portion of a periphery of the hanger running tool, and is configured to block contact between the radially outer surface of the hanger running tool and a radially inner surface of a wellhead in a region proximate to the alignment element as the hanger running tool moves or turns within the wellhead, wherein each of the plurality of alignment elements is disposed within a respective recess defined by a recess surface that extends radially inwardly from the radially outer surface of the hanger running tool, wherein the plurality of alignment elements are disposed between axial flow slots along a circumference of the hanger running tool to enable a flow of fluid through the axial flow slots, and the hanger running tool is configured to couple to a hanger and to facilitate setting the hanger within the wellhead.

15. The hanger running tool of claim 14, wherein the recess surface comprises an upper axial surface and a lower axial surface that converge toward one another along a direction extending from an interior portion of the hanger running tool to the radially outer surface.

16. The hanger running tool of claim 14, wherein at least one of the plurality of alignment elements is formed from a polymer material, an elastomer material, a fabric material, or any combination thereof.

17. The hanger running tool of claim 14, wherein a first alignment element of the plurality of alignment elements and a second alignment element of the plurality of alignment elements are separated from one another along an axial axis of the hanger running tool.

* * * * *